United States Patent [19]

Deal

[11] 4,080,033

[45] Mar. 21, 1978

[54] LOUVERED ELECTRICAL CONNECTOR AND METHOD OF MAKING SAME

[75] Inventor: Robert S. Deal, Los Altos Hills, Calif.

[73] Assignee: Multilam Corporation, Palo Alto, Calif.

[21] Appl. No.: 669,921

[22] Filed: Mar. 24, 1976

[51] Int. Cl.[2] ..... H01R 13/38

[52] U.S. Cl. ..... 339/95 R; 339/258 R

[58] Field of Search ..... 339/95, 252, 255, 256, 339/258, 278

[56] References Cited

U.S. PATENT DOCUMENTS

| | | | |
|---|---|---|---|
| 3,453,587 | 7/1969 | Neidecker | 339/256 RT |
| 3,638,166 | 1/1972 | Steipe | 339/278 C |
| 3,895,853 | 7/1975 | Neidecker | 339/252 R |

*Primary Examiner*—Joseph H. McGlynn

[57] ABSTRACT

An improved electrical connector comprised of a plurality of spaced, angled, electrically conducting fins which are resiliently mounted and have curved outer edges for making electrical bridging contact between conductors disposed on opposite sides of the fins. A device used to bridge a gap between conductors of electrical current. The method of making the device includes providing a generally flat sheet capable of being severed or pierced and expanded, forming a number of pairs of slots in the sheet to present sheet portions between respective slot pairs and then applying oppositely directed forces to the opposed sides of the sheet to expand the same and to cause the sheet portions to be pivoted out of the plane of the sheet and into respective angled positions to form the fins. A permanent set then exists between the fins and the remainder of the sheet or the metal can be hardened. The sheet can be cut into different sizes and shapes to meet specific requirements.

7 Claims, 3 Drawing Figures

FIG. 1
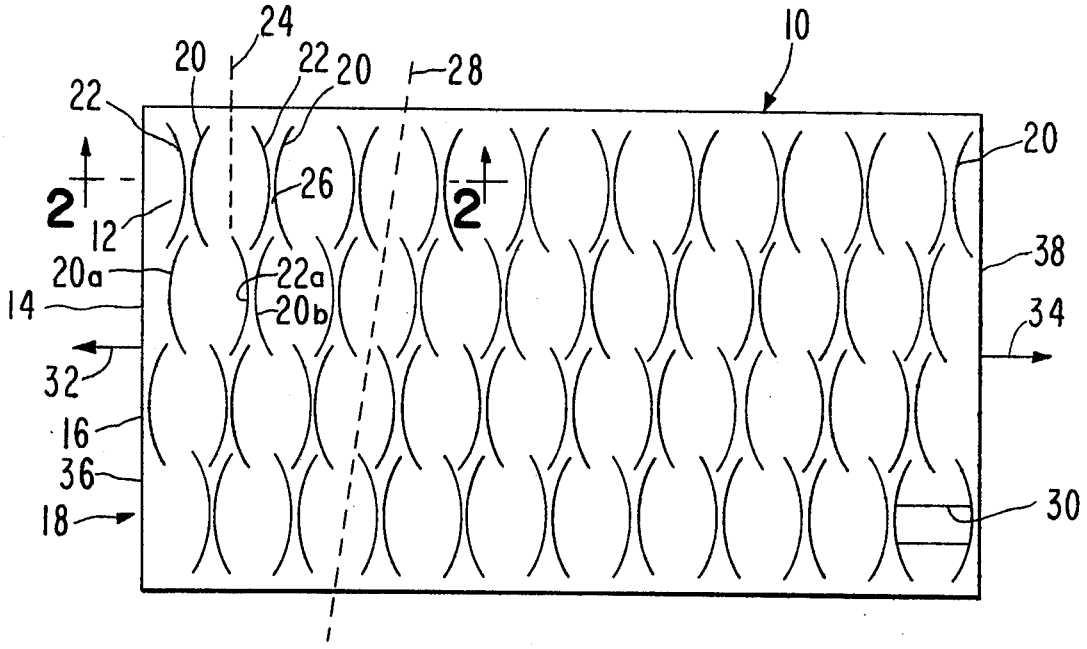
FIG. 2
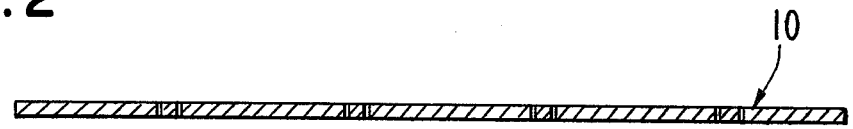
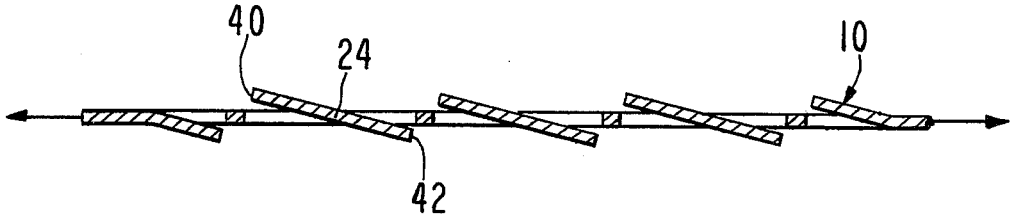
FIG. 3

LOUVERED ELECTRICAL CONNECTOR AND METHOD OF MAKING SAME

This invention relates to improvements in electrical connectors of the louvered contact type and, more particularly, to a louvered contact device and method of making the same in an expansion process.

BACKGROUND OF THE INVENTION

Louvered electrical contact devices have been disclosed in various prior patents, including U.S. Pat. No. 3,453,587. Such a device includes a plurality of angled, spaced, electrically conducting fins having curved outer contact edges, with the ends of each fin being resiliently coupled and integral with adjacent side strips to form a complete assembly which can be used in a flat condition, a curved condition or a cylindrical configuration, depending upon the application to which the device is to be put. Such a device requires intricate dies and other tooling for manufacture and it is desirable to keep production costs at a minimum as much as possible. A need, therefore, has arisen for improvements in devices of this type as well as in the methods for producing the same so that production costs can be minimized without sacrificing the necessary high quality of power transfer to which the devices are designed. This invention permits louvered sheet material to be produced economically and subsequent inexpensive electrical hardware.

SUMMARY OF THE INVENTION

The present invention is directed to an improved louvered electrical contact device and method of making the same wherein the device is initially in the form of a flat sheet of expandable material which can be slotted to form the outlines of a plurality of adjacent fins. Once the slots have been formed so that they extend through the sheet, opposed side forces can be applied to the sheet to expand the same, whereupon the sheet portions between adjacent slot pairs naturally are twisted out of the plane of the sheet by the expansion forces. The result is that the portions between respective slot pairs form the fins of the electrical contact device and the outer edges of the fins will have the same shape as the slots. Immediately after the expansion of the sheets, the resulting electrical contact device can be hardened or is ready for use depending on what metal is used. The device can then be cut into smaller parts or shaped in different configurations, such as a curved or cylindrical configuration, all of which can be accomplished in a minimum of time and with minimum effort.

The device of the present invention, therefore, can be made simply and quickly without special tooling and without sacrificing the desired high quality of the electrical power transfer capabilities of the same. All of this can be accomplished at minimum cost to thereby permit increases in production without substantial increases in costs.

The primary object of this invention is to provide an improved electrical contact device of the louvered type wherein the device is formed from an initially flat sheet of expandable material capable of being severed to form slots therethrough so that, when opposed forces are applied to the sides of the sheet, the sheet material is expanded and the portions between pairs of slots are automatically twisted out of the plane of the sheet and into angled positions to thereby assure that the outer edges of such portions form contact edges for use in engaging adjacent electrical conductors.

Other objects of this invention will become apparent as the following specification progresses, reference being had to the accompanying drawing for an illustration of the invention and the method of making the same.

In the drawing:

FIG. 1 is a plan view of the sheet of material capable of being stamped or otherwise severed to form slots of curved design so that the slots will define louvers of an assembly adapted for forming an electrical connector;

FIG. 2 is a cross-sectional view taken along line 2—2 of FIG. 1; and FIG. 3 is a view similar to FIG. 2 but showing the way in which the louvers are formed when opposed side forces are applied to the sheet to expand it.

The sheet from which electrical connector means of the present invention can be formed is broadly denoted by the numeral 10 and is rectangular in shape and of a material which can be stamped, cut or otherwise severed to form a plurality of pairs of slots in a group of rows denoted by the numerals 12, 14, 16 and 18. The sheet is also of a material which can be expanded after the slots have been formed so that certain portions of the sheet will be moved out of the plane of the slots into angled positions relative thereto and will be permanently set in such positions. Such angled sheet portions will form louvers which can be used to provide the bases for electrical current-carrying paths across the louvers and thereby to electrical terminals or the like on opposite sides of the sheet.

While four rows of slot pairs are shown in FIG. 1, it is clear that any number can be used to carry out the teachings of the present invention. Each pair of slots are spaced apart and are denoted by the numerals 20 and 22, the slots being curved and the concave portions of each pair facing each other. Thus, the slots 20 and 22 of each pair define a sheet portion 15 and the slots of each pair are symmetrical about an imaginary center line 24 through the corresponding sheet portion 15. This slot arrangement is repeated for the entire length of the corresponding row. A single slot 22 is shown at the left end of FIG. 1 and a single slot 20 is shown at the right end thereof; however, these can be eliminated if desired since it is the slot pairs that are required to form the above-mentioned louvers.

Each slot 20 of one slot pair of each row is relatively close to the slot 22 of the adjacent pair of the same row and is in convex relationship thereto. A minimum space 26 (FIGS. 1 and 2) is disposed between each slot 20 of one pair and the proximal slot 22 of the next adjacent pair.

The slot pairs of row 14 are offset relative to the slots pairs of row 12. Similarly, slot pairs of row 16 are offset relative to those of row 14, and the slot pairs of row 18 are offset relative to those of row 16. The arrangement is such that, if one considers an inclined imaginary line 28, (FIG. 1), it will be found that the center lines 24 of the various slot pairs substantially intersect such line 28 as shown in FIG. 1. The inclination of this imaginary line can be selected to be any certain value, the criterion being that the pairs of slots in each row be sufficiently close together so that there are spaces between each adjacent pair of slots, i.e., none of the slots intersect each other. For instance, in row 14, slot **20*a* has its upper end terminating centrally between and spaced from the lower ends of slots 20 and 22 at the left hand end of row 12. Slot 22***a* of row 14 has its upper end terminating centrally between and spaced from the lower ends of slots 20 and 22 of the first pair of slots of row 12. Slot 20*b* has its upper end terminating centrally between and spaced from the lower ends of a slot 22 and the next adjacent slot 20 to the right of the last-mentioned slot. This arrangement is repeated throughout the length of the row 14.

The slots of row 16 fall, with reference to the slots of row 14, in the same arrangement as that described above with respect to rows 12 and 14. Similarly, the slots of row 18 fall, with reference to the slots of row 16, in the same arrangement as described above . The resulting pattern of slots assures that, since none of the slots intersect each other, there will always be spaces between the adjacent ends of the various slots of the row. This is important to cause the louvers to be interconnected after the sheet has been expanded.

Sheet 10 can be formed of a metal, plastic or other material so long as it can be severed to form the above slots and can be expanded to form the above louvers. If the sheet is formed of metal, the metal is preferably chosen so that it is of electrically conductive material. If the sheet is of a plastic material, the louvers resulting from the expansion of the sheet can be coated or clad with a layer of an electrically conducting material either before or after the slot-forming process. This clad material is typically placed at the center portion of the louver.

After the slots have been formed, the sheet is expanded when opposed forces denoted by the arrows 32 and 34 are uniformly applied along the opposed side margins 36 and 38 of the sheet in any suitable manner, such side margins extending longitudinally of the slots. This causes each sheet portion 15 to rotate about its center line 24 and to move out of the plane of sheet 10 into the inclined positions shown in FIG. 3 to form the various louvers having outer, curved side edges 40 and 42. Thus, once the sheet is placed between a pair of spaced electrical terminals, the louvers define the bases for electrical current-carrying paths between edges 40 and 42 of the louvers. If the sheet is of electrically conductive material, edges 40 and 42 will engage the terminals and the louvers will electrically bridge the same to define the electrical path therebetween. If the sheet is of electrically non-conductive material, the louvers will be clad with a layer of electrically conductive material which extends between and about edges 40 and 42 of the louvers. Thus, the layers will electrically contact the terminals and form the electrical path therebetween.

A typical process for forming the slots in sheet 10 and for expanding sheet 10 is as follows:

The sheet is cut and expanded by two sets of rollers. The sheet is unrolled from a large roll and then is passed between a first pair of rollers for cutting the slots in the sheet. One of these two rollers defines a piercing die and the other roller of this pair has the female portion of the corresponding die set. The piercing die pierces the sheet with the desired shape of the fins to form the slots. The sheet then passes between a second pair of rollers which run slightly faster than the first roller set to cause the sheet to be stretched or expanded, causing the fins to be pivoted out of the plane of the sheet. The sheet can now be treated in any suitable manner, such as plating, hardening, tempering or other processing to result in desired characterestics for the sheet.

The present invention provides an improved device and method technique for forming electrical connectors of the louvered type in a minimum of time and with a minimum expenditure of effort. It is a simple matter to form the slots in the sheet, then to apply opposed side forces to expand the sheet to form the various louvers. The device is immediately ready for use if the sheet is electrically non-conductive or if it has been clad with an electrically conductive material. The cladding can be done quickly and easily after expansion.

I claim:

1. A device for use as an electrical connector comprising: a flat sheet of rigid material capable of being severed and expanded, the sheet having a pair of opposed side margins and a number of rows of pairs of curved slots therethrough, each pair of slots being spaced apart and having a portion of the sheet therebetween, each sheet portion having convex outer side edges and defining a fin having a center line symmetrical relative to the corresponding pair of slots, the center lines of the fins of one row being spaced laterally from the center lines of the corresponding fins of the next adjacent row, said sheet being expandable transversely of the side margins thereof by an amount sufficient to cause said fins to pivot about respective center lines and into angled positions transverse to the plane of the sheet, whereby the louvers will define the bases for respective electrical current-carrying paths between a pair of spaced electrical conductors when the sheet is placed between and in proximity to the conductors.

2. A device as set forth in claim 1, wherein the sheet is formed of electrically conductive material.

3. A device as set forth in claim 1, wherein the sheet is formed of electrically non-conductive material and the louvers are adapted to be clad with an electrically conducting material.

4. A device as set forth in claim 1, wherein the sheet is generally rectangular and is provided with a number of rows of slot pairs extending between the side margins, the slots extending longitudinally of the side margins.

5. A device for use in forming a louvered electrical connector comprising: an initially flat sheet of material capable of being severed and expanded, said sheet having a pair of opposed side margins and a plurality of pairs of slots, the slot pairs being in respective rows extending between the side margins of the sheet with the slot pairs of one row being offset relative to the slot pairs of the next adjacent row, each slot being curved, the concave portions of the slots of each pair facing each other and being spaced apart to present a sheet portion therebetween, the end of each slot of one row being between, in proximity to and spaced from the ends of a respective pair of slots of the next adjacent row, whereby the sheet portions between each pair of slots of one row are interconnected with respective sheet portions between corresponding slot pairs of the next adjacent row, said sheet being expandable by forces exerted at the side margins thereof to cause a permanent set therein and to cause the sheet portions between the pairs of slots to pivot about the center lines through the sheet portions symmetrical with respect to and between corresponding pairs of slots, whereby the sheet portions become angled with reference to the plane of the sheet to form fins having outer curved marginal side edges so that the fins, when the material is electrically conductive, will present electrical current-carrying paths to thereby permit the sheet to form an electrical connector when the same is disposed between a pair of spaced electrical current-carrying conductors and when the outer edges of the fins engage the conductors.

6. A device for use as an electrical connector comprising: a flat sheet of rigid material capable of being severed and expanded, the sheet having a pair of opposed side margins and a number of rows of pairs of slots therethrough, the slots of one row being offset relative to the slots of the adjacent row, each pair of slots being spaced apart and having a portion of the sheet therebetween, each sheet portion defining a fin having a center line symmetrical relative to the corresponding pair of slots, said sheet being expandable transversely of the side margins thereof by an amount sufficient to cause said fins to pivot about respective center lines and into angled positions transverse to the plane of the sheet, whereby the louvers will define the bases for respective electrical current-carrying paths between a pair of spaced electrical conductors when the sheet is placed between and in proximity to the conductors.

7. A device for use as an electrical connector comprising: a flat sheet of rigid material capable of being severed and expanded, the sheet having a pair of opposed side margins and a plurality of pairs of slots therethrough, there being at least two rows of slot pairs, each slot of one of the rows having an end between, spaced from and proximal to corresponding ends of two slots of the adjacent row, each pair of slots being spaced apart and having a portion of the sheet therebetween, each sheet portion defining a fin having a center line symmetrical relative to the corresponding pair of slots, said sheet being expandable transversely of the side margins thereof by an amount sufficient to cause said fins to pivot about respective center lines and into angled positions transverse to the plane of the sheet, whereby the louvers will define the bases for respective electrical current-carrying paths between a pair of spaced electrical conductors when the sheet is placed between and in proximity to the conductors.

* * * * *